United States Patent [19]

Bridges et al.

[11] 3,949,876

[45] Apr. 13, 1976

[54] ARTICLES FOR BEVERAGE SERVICE

[75] Inventors: John A. Bridges; Harold W. Storrs, both of Nashville, Tenn.

[73] Assignee: Aladdin Industries, Incorporated, Chicago, Ill.

[22] Filed: Sept. 26, 1974

[21] Appl. No.: 509,496

[52] U.S. Cl. ..... 206/427; 206/503; 206/511; 220/9 F; 220/23.6; 220/23.8

[51] Int. Cl.[2] ..... B65D 85/20; B65D 21/02

[58] Field of Search ..... 206/427, 428, 432, 433, 206/501, 503, 509, 511; 229/2.5; 220/23.6, 9 F, 23.8; 217/26, 26.5, 27

[56] References Cited

UNITED STATES PATENTS

| | | | |
|---|---|---|---|
| 1,574,904 | 3/1926 | Kucera | 206/433 |
| 2,215,252 | 9/1940 | Randall et al. | 217/26 |
| 2,965,226 | 12/1960 | Ettlinger, Jr. | 217/26 X |
| 3,057,510 | 10/1962 | Blacker | 206/509 |
| 3,203,583 | 8/1965 | Amberg et al. | 206/503 X |
| 3,217,875 | 11/1965 | Scheibel | 206/386 |
| 3,224,575 | 12/1965 | Whiteford | 220/23.6 X |
| 3,351,264 | 11/1967 | Bostrom | 206/433 X |
| 3,482,756 | 12/1969 | Collie | 206/427 X |
| 3,532,247 | 10/1970 | Bridges | 206/503 X |
| 3,684,123 | 8/1972 | Bridges | 206/503 X |

FOREIGN PATENTS OR APPLICATIONS

| | | | |
|---|---|---|---|
| 1,474,782 | 2/1967 | France | 206/433 |

*Primary Examiner*—William Price
*Assistant Examiner*—Stephen Marcus

[57] ABSTRACT

Apparatus for serving beverages comprises a thermally insulated tray having depressions on its upper surface for receiving the bottoms of insulated tumblers or mugs. A similar tray rests on top of the tumblers with the tops of the tumblers received in recesses formed in the bottom surface of the upper tray. In use these alternating layers of trays and tumblers may be stacked and beverages in the tumblers held at desired temperatures until served.

3 Claims, 8 Drawing Figures

ARTICLES FOR BEVERAGE SERVICE

BACKGROUND OF THE INVENTION

This invention relates generally to beverage or liquid service articles. More specifically it relates to insulated containers and trays for serving beverages.

Very frequently it is desired to serve beverages in a wide variety of institutions such as schools or hospitals or in other public or quasi public places such as airplanes, meeting halls and the like. Very frequently it is desirable to prepare the beverages ahead of time and to place them in individual containers so that at the time of actual service it can be done rapidly and efficiently. However, under such circumstances it is considered desirable that the beverage at the time of actual service be at or near an optimum service temperature. That is to say, that hot liquids be hot and cold liquids be cold. It is usually difficult to achieve these objectives without providing means for heating or cooling at the point of service. Yet such means require a source of energy connected to a serving device such as a coffee urn. Alternatively, an insulated bulk container may be used and individual servings drawn from the container through a tap or spigot. These kinds of serving means increase the service time required and usually necessitate the presence of a serving person, thus adding to the labor cost.

In institutions the latter situation is sometimes aggravated because the beverage to be served could very easily be prepared during the work period in the normal course of the day, but if bulk service is used very frequently additional people are required if the actual service is to occur late in the evening, as is often the case in hospitals.

To obviate the foregoing deficiencies it is an object of this invention to provide a novel beverage serving system wherein individual portions of a beverage may be prepared a considerable time before they are intended to be served and held at a desired serving temperature until individual service is actually made.

It is a further object of this invention to provide a novel beverage service system which permits the economical and compact storage of beverage service devices until they are required to be used.

It is a still further object of this invention to provide novel beverage service devices which may be easily transported and handled by a person making the beverage service.

Another object of this invention is to provide novel beverage service devices which may be used to hold beverages of different temperatures for relatively long periods of time at their desired serving temperatures.

BRIEF SUMMARY OF THE INVENTION

The foregoing and other objects of the invention are achieved in an embodiment of the invention by the provision of thermally insulated trays which may also function as covers capable of holding and providing thermal insulation for a plurality of tumblers or liquid containers.

BRIEF DESCRIPTION OF THE DRAWINGS

The invention itself is set forth in the claims appended hereto and forming a part of this specification, while an understanding of an embodiment thereof may be had by reference to the detailed description taken in conjunction with the drawings in which:

DETAILED DESCRIPTION

Figure 1:
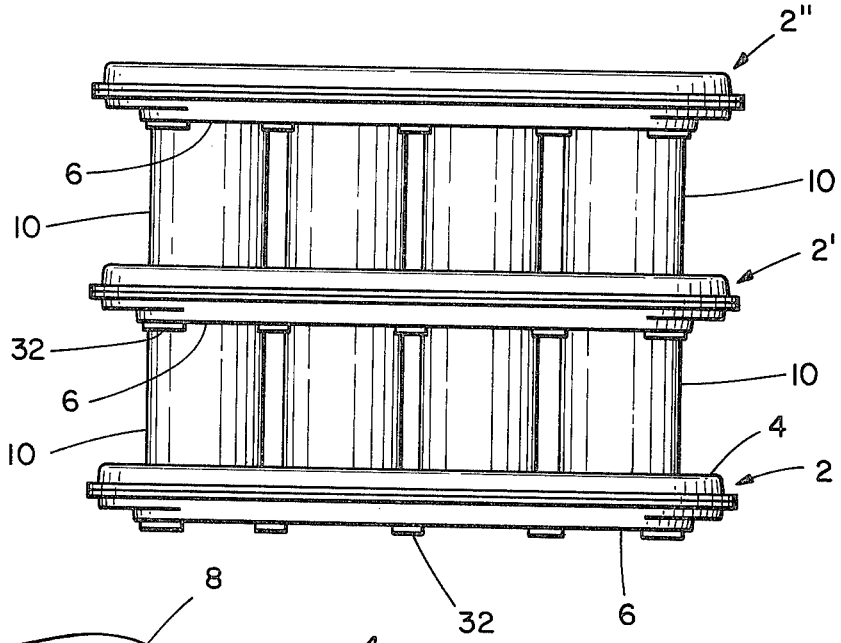
FIG. 1 is a side view of an embodiment of the invention.
Figure 2:
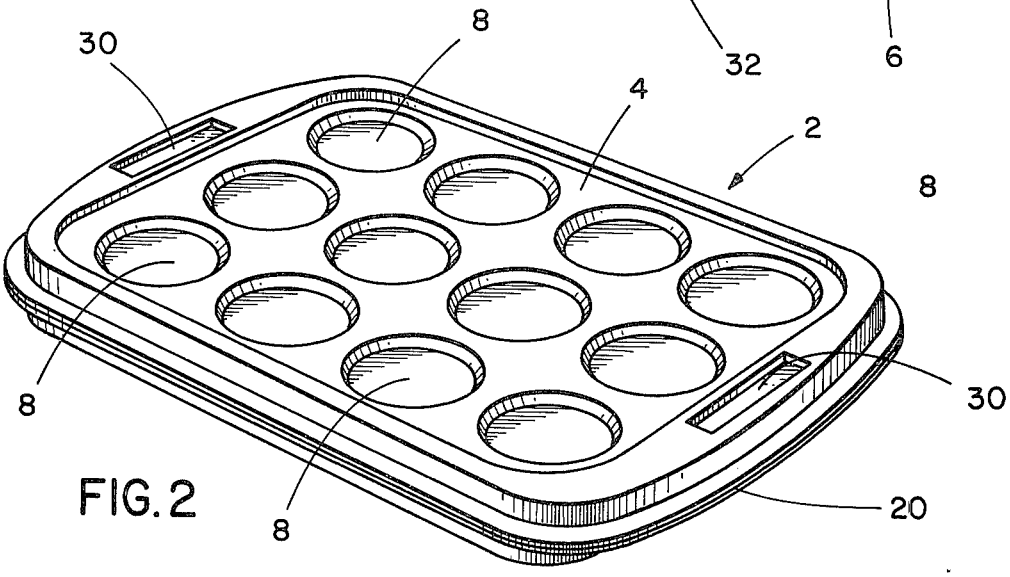
FIG. 2 is a top view in perspective of an insulated tray forming a part of the invention.
Figure 3:
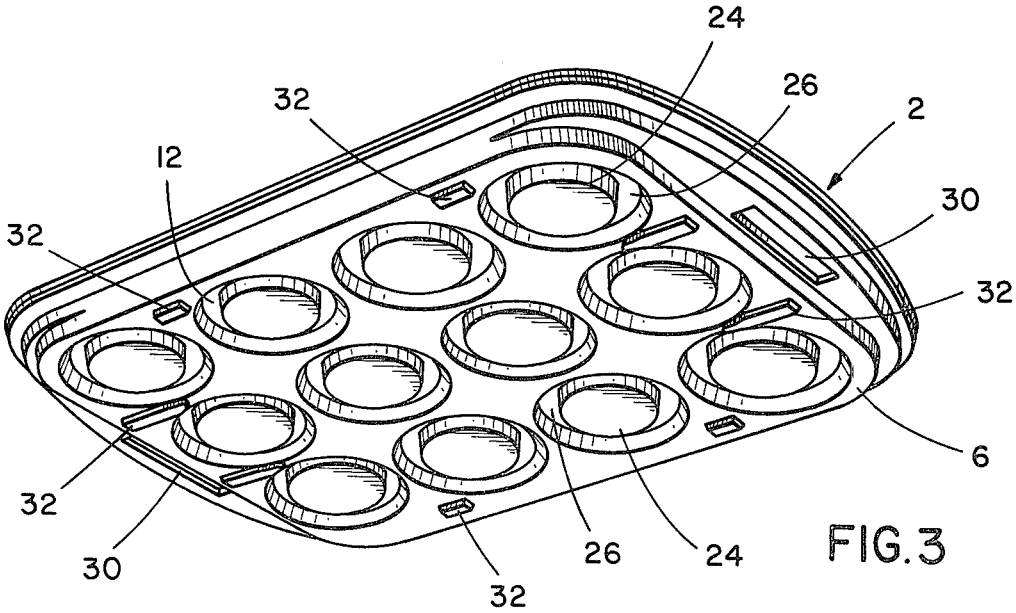
FIG. 3 is a bottom view in perspective of the tray of FIG. 2.
Figure 4:
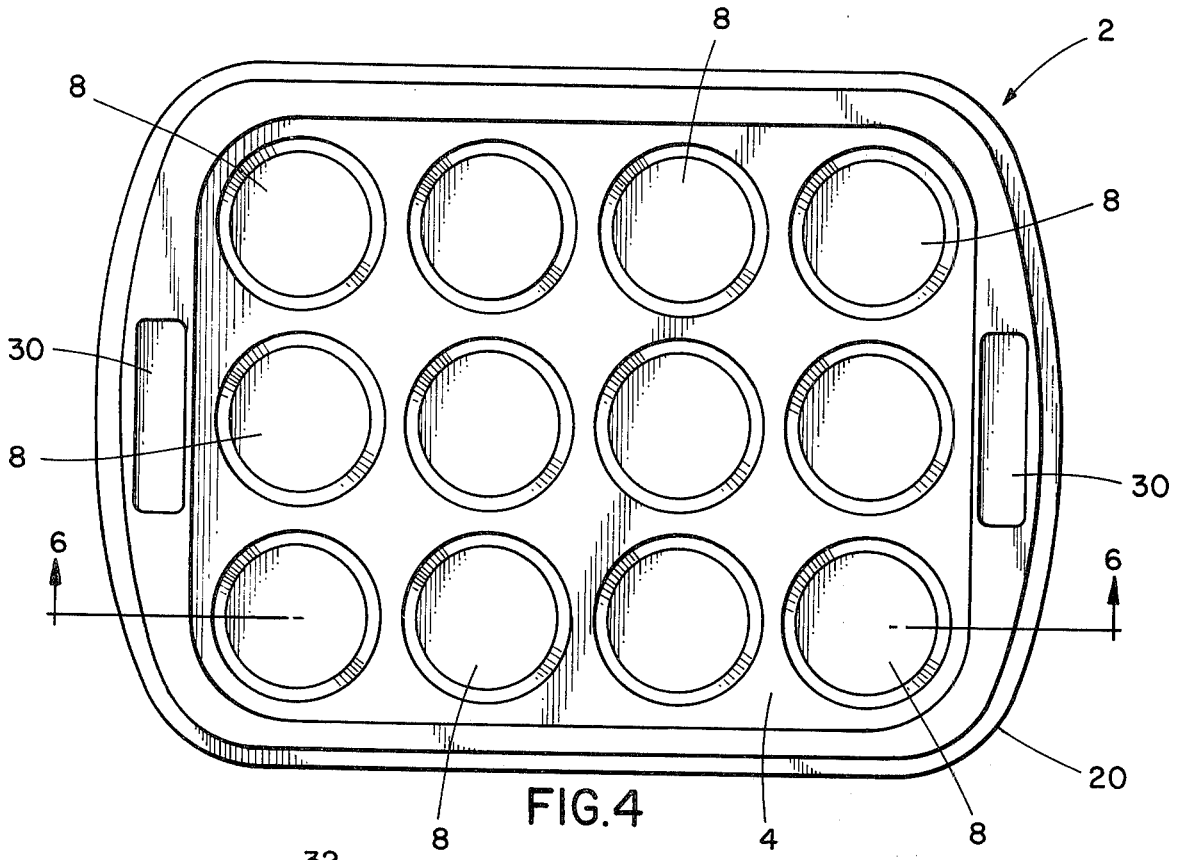
FIG. 4 is a plan view of the tray of FIG. 2.
Figure 7:
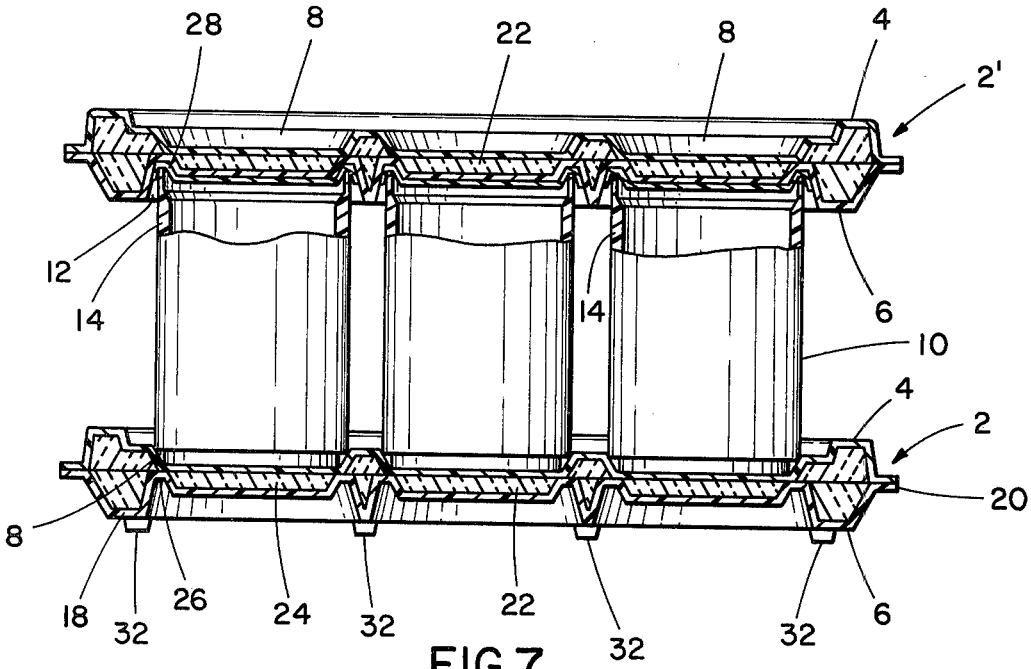
FIG. 7 is a side view, partially in section, of containers and trays in accordance with the invention.

Referring first to FIGS. 1 and 7 it can be seen that containers and trays in accordance with the invention may be constituted by a first tray 2 having an upper surface 4 and a lower surface 6. A plurality of recesses or depressions 8 are formed in the upper surface and are dimensioned to receive the bottoms of plurality containers 10.

A second tray 2′ identical in construction to the first tray 2 is likewise provided with an upper surface 4 and a lower surface 6. A plurality of recesses 12 are provided in the lower surface 6, which recesses correspond generally in confirmation and position to the recesses 8.

In use the containers 10 may be filled with a beverage desired to be served and placed in the recesses 8 on the tray 2. When so filled and located the second tray 2′ is placed on the top of the containers. Whereas single beverage containers with thin disposable lids would not be thermally efficient, when assembled the trays and containers provide effective thermal insulation for any beverage desired to be served. If it is desired to stack more trays and containers for distribution and serving purposes this may be done as shown in FIG. 1, wherein additional containers are placed on the upper surface of the tray 2′ and their tops closed off by a third tray 2″. In this manner a number of containers may be carried by hand or on a cart from a central food preparation area to various points of service and the individual containers containing a beverage dispensed to individual users.

The containers themselves may be constructed in any fashion to suit a designer serving any aesthetic purpose he has in mind. It is contemplated that the containers may take the form of tumblers formed out of a plastic material to have a side wall 14 capable of providing thermal insulation.

FIGS. 2, 3, 6 and 7 illustrate a preferred embodiment of an insulated tray in accordance with the invention. Thus in FIG. 7 it may be seen that each tray is constituted by an upper skin 16 and a lower skin 18, which skins may be formed by vacuum molding a suitable plastic material. After the skins 16 and 18 have been formed a quantity of foamable plastic material is placed in one of the skins and the two skins joined together at a seam 20 by thermal welding or the use of an adhesive. The foamable material is then activated by the use of heat and/or a catalyst so as to fill up the space between the skins to form the thermal insulation 22. The resulting construction is one, therefore, which is capable of providing thermal insulation in the vertical direction.

In order to provide a thermal seal around the upper open ends of the containers or tumblers 10, each bottom recess 12 is formed so as to have a downwardly projecting portion 24 surrounded by a groove 26. Thus when a number of containers and trays are assembled as shown in FIG. 7 the upper edge 28 of each container 10 engages in a groove 26 with the portion 24 extending slightly into the open end of the container whereby an effective thermal seal is provided.

Figure 5:
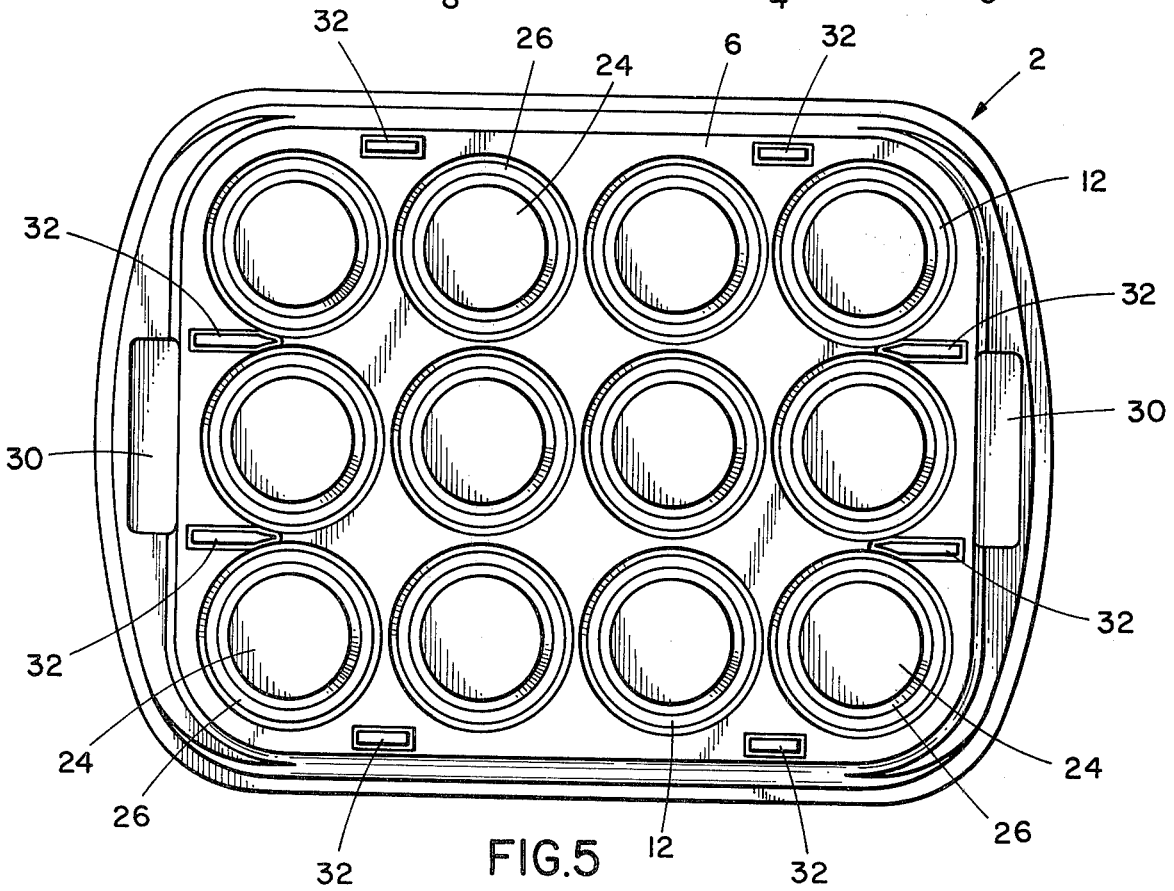
FIG. 5 is a bottom view of the tray of FIG. 2.
Figure 6:
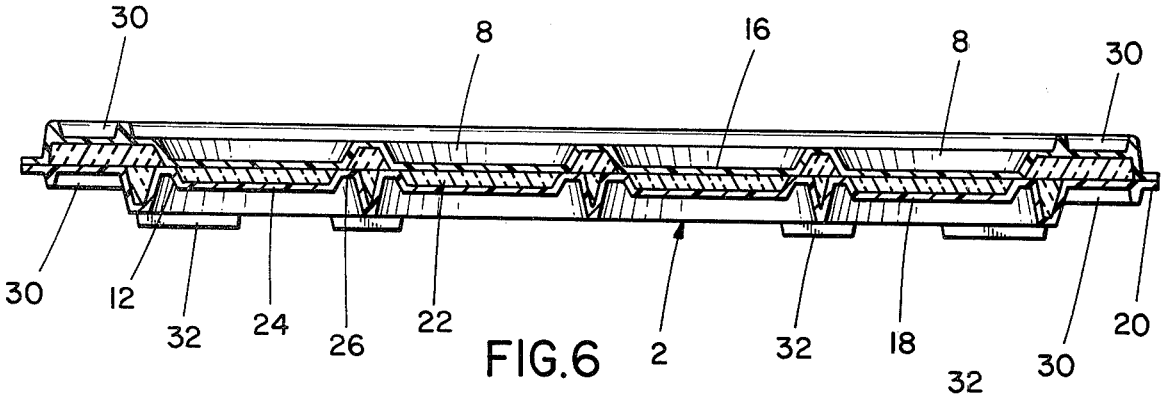
FIG. 6 is a view along the line 6—6 of FIG. 4.
Figure 8:
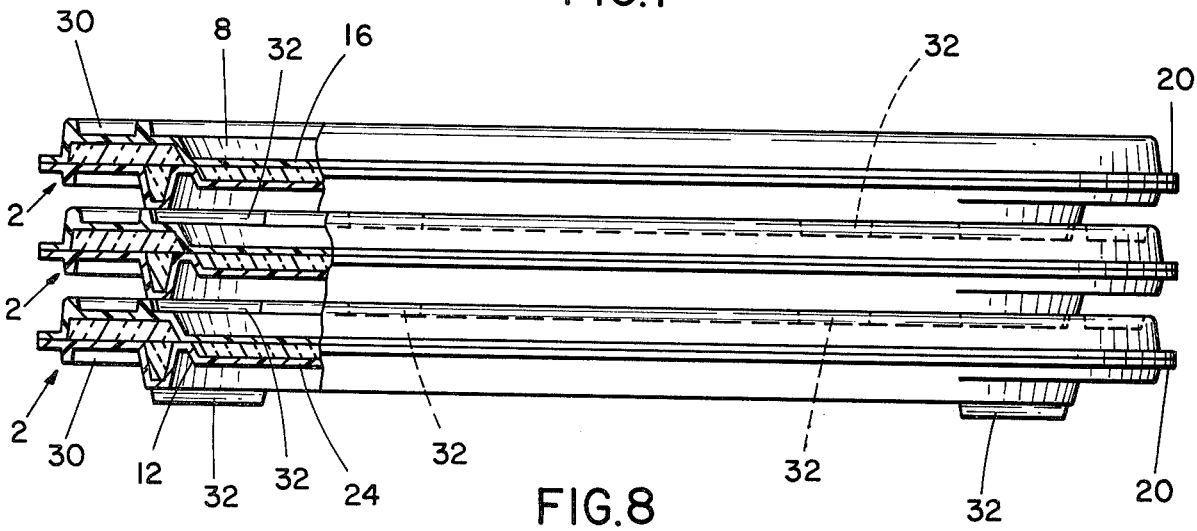
FIG. 8 is a side view, partially in section, of a plurality of trays in accordance with the invention illustrating how they may be stacked for storage purposes.

In addition to the foregoing, features, if desired, such as slots or openings 30 may be provided in each tray to provide means for them to be grasped and carried as desired. To facilitate the storage of trays the bottom surface 6 of each tray is provided with downwardly extending projections or lugs 32 (see FIGS. 5, 6 and 8) which when the trays are stacked interengage with the top of a tray below in order to prevent relative movement between the trays.

It is intended by the claims appended hereto to cover all modifications of or variations in the invention hereof as come within their scope.

What is claimed as new and desired to be secured by Letters Patent is:

1. Beverage service means comprising a first tray having an upper surface and a lower surface, said upper surface having a plurality of uniform recesses provided therein for receiving the bottoms of a plurality of beverage containers, said lower surface having a plurality of downwardly projecting portions conforming in number, disposition and generally in size to said recesses, each downwardly depending portion being relatively thick to provide thermal insulation, each downwardly depending portion being surrounded by a groove formed in said lower surface, a second tray identical in construction to said first tray, and a plurality of beverage containers having their bottoms disposed in the recesses of one tray and their tops disposed in the grooves of the other tray.

2. Beverage service means of claim 1 wherein said containers are formed of a thermally insulating material.

3. Beverage service means as set forth in claim 1 wherein said bottom surface of each tray has a plurality of lugs formed thereon to facilitate stacking.

* * * * *